United States Patent [19]

Wittrisch

[11] Patent Number: 4,660,635

[45] Date of Patent: Apr. 28, 1987

[54] EQUIPMENT FOR A PIPE STRING SUCH AS A DRILL-PIPE STRING, COMPRISING A SIDE ENTRY CONNECTION FOR PASSING A CABLE

[75] Inventor: Christian Wittrisch, Rueil Malmaison, France

[73] Assignee: Institut Francais du Petrole, Rueil-Malmaison, France

[21] Appl. No.: 862,633

[22] Filed: May 13, 1986

[30] Foreign Application Priority Data

May 13, 1985 [FR] France ..... 85 07341

[51] Int. Cl.[4] ..... E21B 29/04

[52] U.S. Cl. ..... 166/54.5; 166/156; 166/385

[58] Field of Search ..... 166/55.1, 117.5, 153–156, 166/55, 298, 383, 385, 54.5, 65.1, 301, 242

[56] References Cited

U.S. PATENT DOCUMENTS

| | | | |
|---|---|---|---|
| 1,776,026 | 9/1930 | Hinderliter | 166/54.5 |
| 2,249,358 | 7/1941 | Haynes | 166/54.5 |
| 2,515,377 | 7/1950 | Miller | 166/54.5 |
| 3,020,957 | 2/1962 | Tausch | 166/54.5 |
| 3,073,388 | 1/1963 | Chenault | 166/54.5 |
| 4,043,392 | 8/1977 | Gazda | 166/154 |
| 4,160,478 | 7/1979 | Calhoun et al. | 166/55.1 |
| 4,388,969 | 6/1983 | Marshall et al. | 166/385 X |
| 4,427,070 | 1/1984 | O'Brien | 166/317 |
| 4,512,411 | 4/1985 | Pringle | 166/55.3 X |
| 4,524,834 | 6/1985 | Barron et al. | 166/385 |

*Primary Examiner*—Stephen J. Novosad

*Attorney, Agent, or Firm*—Antonelli, Terry & Wands

[57] ABSTRACT

A side-entry connection for incorporation in pipe strings, such as a drill-pipe string, and for sealingly passing a cable from the inside to the outside of the pipe string is disclosed. The side-entry connection comprises a connection sub and a sleeve which is slidable inside the axial bore of the connection sub between a top position above said cable entry and a low position in which the sleeve closes said cable entry. Means are provided for retaining the sleeve in each of said positions, and the sleeve includes cutting means at its lower end for severing the cable when the sleeve is moved to its lower position. A retrievable plug is used to close the top of the sleeve and hydraulic pressure is applied to the plug from the surface so as to move the sleeve from its top position to its low position for closing the side entry and for severing the cable.

2 Claims, 2 Drawing Figures

EQUIPMENT FOR A PIPE STRING SUCH AS A DRILL-PIPE STRING, COMPRISING A SIDE ENTRY CONNECTION FOR PASSING A CABLE

BACKGROUND OF THE INVENTION

1. Field of the Invention

The present invention relates to equipment for pipe string such as drill pipe string comprising a side entry connection for passing a cable from the inside to the outside of the pipes, with hydraulic sealing about the cable.

2. Description of the Prior Art

Side entry connections (generally designated by side entry subs in the oil industry) are well known by oil drilling specialists. Such a device is for example described in the British Pat. No. 2,135,719.

A side entry connection is, for example, used in the technique described in the French Pat. No. 2,501,777 (EN 81/05.271) and its first two additions EN 82/03.317 and EN 84/08.369.

According to this technique, for carrying out well-logging or interventions in horizontal or steeply inclined wells, a logging probe or an intervention tool is initially fixed to the lower part of a pipe string which is lowered into the well as it is formed.

Then an electric cable is lowered inside the pipes (by gravity and by pumping) having a weighted connector (the connector has mounted thereover a load bar) which is connectable to a complementary connector fixed to the top of the probe (or the tool). In the portion of the pipe string corresponding to the vertical or slightly inclined part of the well, a side entry connection allows the cable to pass from the inside to the outside of the pipes.

Recording of the measurement (or the intervention in the well) is effected by moving the pipe string assembly from the surface.

Present equipment comprising a side entry connection raise a problem, however, should the pipe string be jammed in the well.

In fact, the presence of the electric cable contained inside the rods in the part between the side entry connection and the load bar does not allow operations to be carried out for unjamming the pipe string.

These unjamming operations or interventions are, for example, the introduction into the pipe, from the surface, of specialised tools which have to be lowered by means of a cable as far as the zone (which is generally situated under the side entry connection) which comprises the pipes jammed by the formation.

These specialized tools may, for example, be an explosive for unscrewing the jammed pipe.

Moreoever, the presence of the cable inside the pipe string, above the side entry connection, limits the possibilities of rotation of the pipe string.

SUMMARY OF THE INVENTION

This problem is solved in accordance with the invention by means of an assembly for a drill rod string comprising a side entry connection adapted for incorporation in the pipe string, this entry allowing the cable to pass therethrough, further comprising a sleeve, slidable inside said connection between a top position situated above said entry and a low position in which this sleeve closes said entry, said sleeve being provided with members for retaining it in each of said positions and comprising means for cutting the cable when said sleeve passes from its top position to its bottom position.

In particular embodiment, the assembly of the invention comprises a plug for closing said sleeve at its upper end, this plug allowing said sleeve to move from its top position to its low position under the effect of a hydraulic pressure exerted from the surface in the drill pipe and comprising at its top a removal and recovery member.

The prior art may be illustrated by the following U.S. Pat. Nos. 1,854,477, 4,031,957, 4,427,070, 3,661,207, 4,512,411 and 4,160,478.

Among these patents, some relate to the flow control by sliding the sleeve in a casing which controls the passage section of communication orifices, these patents do not teach severing of a cable.

U.S. Pat. No. 4,512,411 teaches cutting a cable, passing through a cylinder from one side to the other. In this prior patent, cutting of the cable is achieved by shearing by a radial movement of jaws.

The U.S. Pat. No. 4,160,478 provides principally for the perforation of a tubing in a casing and passing therethrough from one side to the other.

According to this prior patent, the cutting member rotates about an axis. During this rotation it penetrates into the pipe causing partial tearing ot the latter.

Both these prior documents do not concern cables passing trough a side entry connection and the cutting member does not consist of a sliding sleeve.

BRIEF DESCRIPTION OF THE DRAWINGS

An example of embodiment of an equipment according to the invention is illustrated by the accompanying figures in which.

DESCRIPTION OF THE PREFERRED EMBODIMENT

Figure 1:
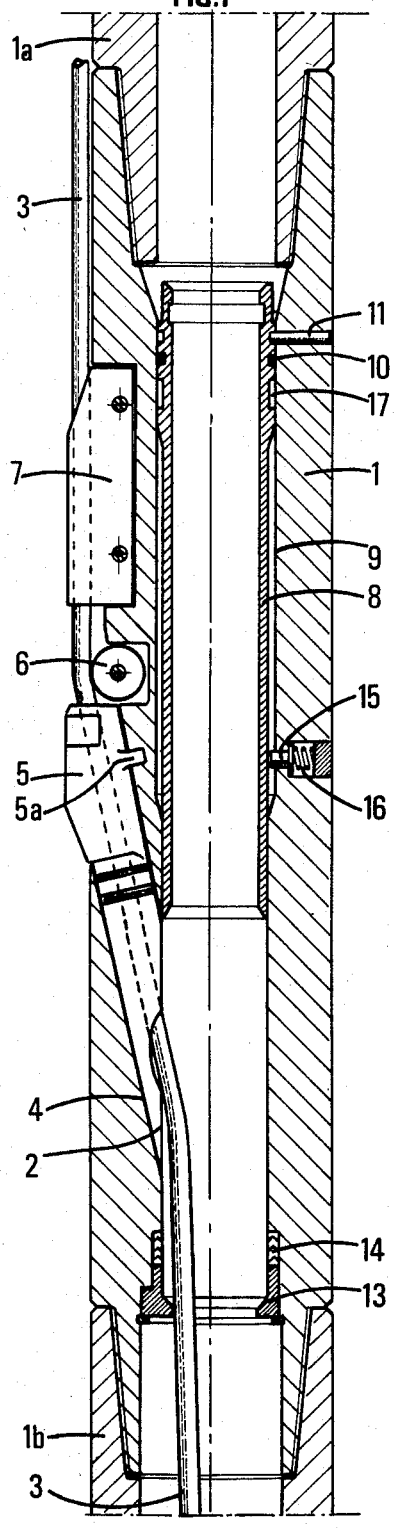
FIG. 1 shows the equipment in a first position in which the cable is passing from the inside to the outside of the pipe.

In the illustrated examples reference 1 designates a side entry sub screwed between two members 1*a* and 1*b* of the string of pipe.

This sub comprises a side entry sub 2 permitting an electric cable 3 to pass from the outside to the inside of the pipe along a ramp 4. This cable is, for instance, from the type used in well-logging or for interventions carried out according to the technique described in French patent FR-A-2,501,777 and its already cited additions.

A member 5 provides for tightness around the cable 3 at the location where the latter passes from the inside of the sub 1, this member being fixed by a locking pin 5*a*, to the outside of the sub 1, the cable successively passing around a guide rod 6 and an anchoring member 7 where it is mechanically locked by a system of any suitable type, comprising for instance a shearable pin, permitting releasing of the cable 3 under the action of sufficient strength traction exerted from the surface.

The formation of members 5 and 7 is within the scope of specialists and will not be described here in detail.

A sleeve 8 is mounted for sliding in the axial bore 9 of connection 1, sealing being provided between the sleeve 8 and bore 9 for example by means of an O-seal 10.

FIG. 1 shows the sliding sleeve 8 in its top position, covering the entry 2, so as to allow cable 3 to pass.

A shear-pin 11 holds the sleeve 8 in this position.

Figure 2:
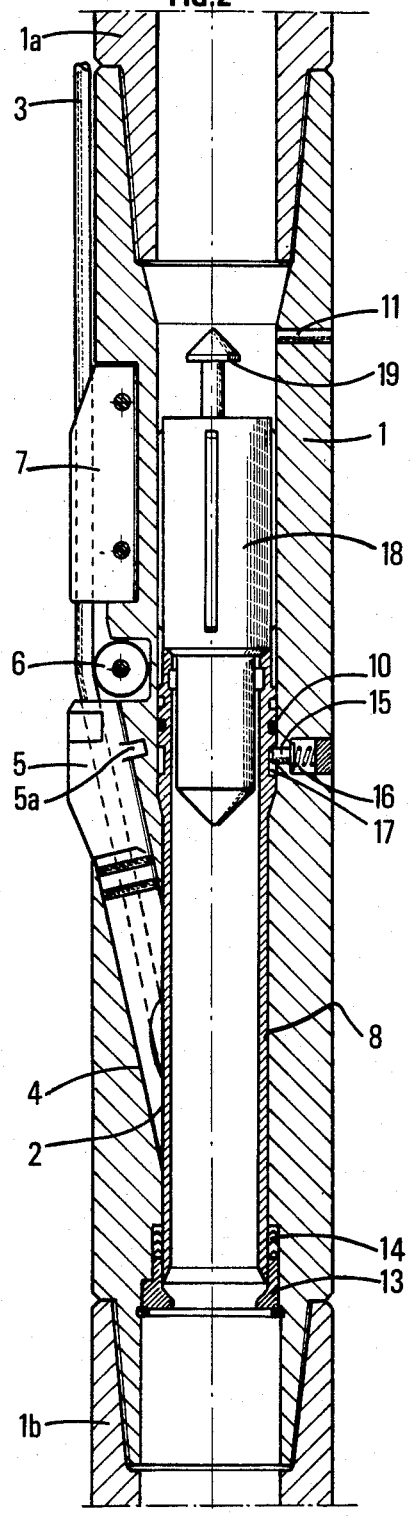
FIG. 2 illustrates the equipement in a second position in which the cable is severed and the side entry sub is obstructed.

FIG. 2 illustrates the second position of the sleeve 8 where this sleeve closes the side entry 2.

The wall of the sliding sleeve 8 is tapered at its lower part so as to form a cutting member with bevelled section 12, adapted for severing cable 3 in its low position, this member then coming into contact with ring 13 forming an annular shoulder retaining the sleeve 8.

Reference 14 designates an annular sealing member placed above ring 13.

A safety pin 15, withdrawable against the action of a spring 16, is applied against the external wall of sleeve 8 in the top position of FIG. 1, whereas in the position shown in FIG. 2, this pin is engaged in an appropriate housing 17 formed in the head of the sliding sleeve 8.

A plug 18 may be fitted to the upper part of the sliding sleeve 8 for closing same. This plug having a removal and recovery head 19 for gripping the plug 18 by any appropriate tool which may be of a known type.

This tool for removal and recovery of the closure plug 18 will be placed at the lower end of a cable or a handling pipe (not shown).

Plug 18 allows sleeve 8 to be moved from its top position (FIG. 1) to its low position (FIG. 2) under the effect of a hydraulic pressure exerted from the surface in the drill pipe.

The use of this equipment is described here below:

With the equipment in its normal operating position shown in FIG. 1, the following successive operations are carried out, in the case where difficulties such as jamming of the pipe string, lead to raising the cable without the possibility of raising the pipe string:

(a) by pulling on cable 3 from the surface, this latter is released from member 7;

(b) then the greatest cable length possible is raised to the surface by sliding through the sealing member 5, for example until the load bar mounted over the electric connector reaches just below the side entry 2, in the example of implementation of the technique described in French Pat. No. 2,501,777;

(c) then the block or piston 18 which is to close the sleeve 8 at its upper end is lowered from the surface;

(d) a hydraulic pressure is applied to this piston from the surface; the retaining pin 11 is then sheared and the sliding sleeve 8 travels down to its low position shown in FIG. 2, the lower cutting end 12 of this sleeve then severing cable 3 (in the example of the technique described in French Pat. No. 2,501,777, the electric connector on which is mounted the load bar which is no longer retained by the cable, falls back then inside the pipes and this assembly may be recovered subsequently when the pipe string is raised, when this latter will have to be unjammed); in this low position, the wall of sleeve 8 closes the side entry 2;

(e) the portion of cable 3 situated above connection 1 may then be recovered, the cable being reeled in from the surface.

Sleeve 8 is held in low position by the engagement of pin 15 in housing 17.

Seals 10 and 14 situated respectively at the upper part and at the lower part of sleeve 8 then provide good sealing between the inside and the outside of the pipe string Under these conditions, it is possible, after removal of plug 18, to unjam the pipe string by rotation thereof from the surface with a flow of fluid inside the pipes as far as the bottom of the pipe string, the fluid rising through the annular space separating the pipe string from the wall of the well.

Such unjamming may also be practiced by introducing into the pipes from the surface tools of types well known to drillers for unscrewing the pipes.

What is claimed is:

1. Equipment for drill-pipe string comprising a side entry connection adapted for incorporation in the pipe string, this entry allowing the passage of a cable, comprising a sleeve slidable inside said connection between a top position situated above said entry and low position in which said sleeve closes said entry, said sleeve being provided with members for retaining it in each of said positions and comprising means for severing the cable when said sleeve passes from a top position to its low position.

2. Equipment as claimed in claim 1, further comprising a plug for closing said sleeve at its upper end, said plug allowing said sleeve to move from its top position to its low position under the effect of a hydraulic pressure and comprising at its top a removal and recovery member.

* * * * *